US007812796B2

(12) United States Patent
Jung

(10) Patent No.: US 7,812,796 B2
(45) Date of Patent: Oct. 12, 2010

(54) PIXEL CIRCUIT OF ORGANIC LIGHT EMITTING DISPLAY

(75) Inventor: Sang Hoon Jung, Gyeonggi-do (KR)

(73) Assignee: LG. Display Co., Ltd., Seoul (KR)

( * ) Notice: Subject to any disclaimer, the term of this patent is extended or adjusted under 35 U.S.C. 154(b) by 758 days.

(21) Appl. No.: 11/823,259

(22) Filed: Jun. 26, 2007

(65) Prior Publication Data

US 2008/0122381 A1 May 29, 2008

(30) Foreign Application Priority Data

Jun. 27, 2006 (KR) ..... 10-2006-0058326

(51) Int. Cl.
*G09G 3/20* (2006.01)

(52) U.S. Cl. ..... 345/76; 345/82; 345/87; 345/92

(58) Field of Classification Search ..... 345/36, 345/39, 42, 44–46, 48, 76–78, 81–88, 90–92, 345/95, 204, 214, 690; 315/169.1, 169.3
See application file for complete search history.

(56) References Cited

U.S. PATENT DOCUMENTS 7,259,735 B2 * 8/2007 Kasai ..... 345/77
7,573,441 B2 * 8/2009 Kwon ..... 345/76
7,688,292 B2 * 3/2010 Park et al. ..... 345/82
2007/0200793 A1 * 8/2007 Kwon ..... 345/39

FOREIGN PATENT DOCUMENTS

CN 1691116 A 11/2005
JP 2004-246204 9/2004

OTHER PUBLICATIONS

Office Action issued in corresponding Chinese Patent Application No. 200710108913.5; issued Mar. 6, 2009.

* cited by examiner

*Primary Examiner*—Richard Hjerpe
*Assistant Examiner*—Mansour M Said
(74) *Attorney, Agent, or Firm*—Brinks Hofer Gilson & Lione

(57) ABSTRACT

A pixel circuit includes a first transistor transmitting a reference signal or a data signal in response to a selection signal applied through a scan line, second and third transistors inputting a reference current in response to a control signal applied through a control line, a first capacitor storing a voltage compensated by the input reference current to compensate for the data signal received from the first transistor, a second capacitor storing the compensated data signal by the first capacitor, a fourth transistor receiving the compensated data signal to generate a driving current, a fifth transistor transmitting the driving current in response to the control signal applied through the control line, and an organic light emitting diode receiving the driving current from the fifth transistor to emit light.

14 Claims, 5 Drawing Sheets

PIXEL CIRCUIT OF ORGANIC LIGHT EMITTING DISPLAY

This application claims the benefit of Korea Patent Application No. 10-2006-058326, filed on Jun. 27, 2006, which is incorporated herein by reference for all purposes as if fully set forth herein.

BACKGROUND OF THE INVENTION

1. Field of the Invention

This document relates to a pixel circuit of an organic light emitting display.

2. Discussion of the Related Art

The importance of flat panel displays has recently increased with the growth of multimedia. Various types of flat panel displays such as liquid crystal displays (LCDs), plasma display panels (PDPs), field emission displays (FEDs), organic light emitting displays have been put to practical use.

The organic light emitting display has rapid response time, low power consumption, and self-emission structure. Furthermore, the organic light emitting display has a wide viewing angle, so that it can excellently display a moving picture regardless of the size of the screen or the position of a viewer. Because the organic light emitting display may be manufactured in low temperature environment using a semiconductor fabrication process, the organic light emitting display has a simple manufacturing process. Hence, the organic light emitting display is attractive as a next generation display.

Generally, the organic light emitting display has N×M organic light emitting diodes arranged in a matrix format and may be voltage driven or current driven, thereby displaying a predetermined image. The driving methods of the organic light emitting display include a passive matrix type and an active matrix type using a thin film transistor. In the passive matrix type, an anode electrode is at right angles to a cathode electrode. The anode electrode is selected by a scan signal and the cathode electrode receives a data signal, so that an organic light emitting diode (OLED) emits light in response to the data signal applied between the cathode electrode and the anode electrode. In the active matrix type, the thin film transistor is connected to a pixel electrode and a gate electrode of the thin film transistor is connected to a capacitor, so that the OLED emits light depending on a voltage stored in the capacitor.

FIG. 1 is a block diagram of a related art organic light emitting display.

Referring to FIG. 1, the organic light emitting display has a display panel 110, a scan driver 120, a data driver 130, a controller 140, and a power supply 150.

The display panel 110 includes data lines D1-Dm, scan lines S1-Sn, and pixel circuits P11-Pnm. The data lines D1-Dm are arranged in a first direction, and cross the scan lines S1-Sn arranged in a second direction. The pixel circuits P11-Pnm are disposed at pixel areas defined by the data lines D1-Dm and the scan lines S1-Sn.

The controller 140 outputs control signals to the scan driver 120, the data driver and the power supply 150. The power supply 150 outputs necessary voltages to the scan driver 120, the data driver and the display panel 110 in response to the control signals received from the controller 140.

The scan driver 120 outputs scan signals to the scan lines S1-Sn connected to the scan driver 120 in response to the control signal of the controller 140. Hence, the pixel circuits P11-Pnm of the display panel 110 are selected by the scan signals.

The data driver 130 outputs data signals synchronized with the scan signals to the data lines D1-Dm connected to the data driver 130 in response to the control signal of the controller 140. Then, the data driver 130 applies the data signals to the corresponding pixel circuits P11-Pnm through the data lines D1-Dm. Hence, the pixel circuits P11-Pnm emit light in response to the data signal to display a predetermined image on the display panel 110.

FIG. 2 is a circuit diagram of a pixel circuit of a related art organic light emitting display.

Referring to FIG. 2, the pixel circuit includes a switching transistor MS, a capacitor Cgs, a driving transistor MD, and an organic light emitting diode (OLED). The switching transistor MS transmits a data signal from a data line Dm in response to a scan signal of a scan line Sn. The data signal received through the switching transistor MS is stored in the capacitor Cgs. The data signal stored in the capacitor Cgs is used to generate a driving current for the driving transistor MD. Hence, the OLED emits light depending on the driving current.

A driving current $I_{OLED}$ flowing into the OLED is expressed by the following equation 1.

$$I_{OLED} = \frac{1}{2}K(Vgs - Vth)^2, \quad K = \mu Cox\frac{W}{L} \qquad \text{[Equation 1]}$$

Where μ denotes field-effect mobility, Cox capacitance of an insulating layer, W a channel width, and L a channel length.

The current flowing into the OLED of the pixel circuit may be determined by a gate voltage and a threshold voltage Vth of the driving transistor MD and a voltage of a first power supply VDD. To ensure uniformity between luminances of pixels, uniformity of characteristics of thin film transistors, particularly, uniformity of the threshold voltages and mobility of thin film transistors should be achieved.

However, because a voltage drop occurs in a first power supply line VDD for supplying power supply to each pixel circuit, a voltage of the first power supply line VDD supplied to each pixel circuit varies according to a location of each pixel circuit. Because there are changes in a current flowing into the OLED of each pixel circuit, non-uniformity between luminances of pixels occurs.

Further, a thin film transistor used in the organic light emitting display uses poly-silicon. Grain size of the poly-silicon may not be uniform. Hence, uniformity of characteristics of thin film transistors, particularly, uniformity of the threshold voltages and mobility of thin film transistors should be achieved in order to have a uniform display.

SUMMARY OF THE INVENTION

In one aspect, a pixel circuit of an organic light emitting display comprises first to fifth transistors, first and second capacitors, and an organic light emitting diode. The first transistor transmits a reference signal or a data signal in response to a selection signal applied through a scan line. The second and third transistors input a reference current in response to a control signal applied through a control line. The first capacitor stores a voltage compensated by the input reference current to compensate for the data signal received from the first transistor. The second capacitor receives stores the data signal compensated by the first capacitor to store the compensated data signal. The fourth transistor receives the compensated data signal stored in the second capacitor to generate a driving current. The fifth transistor transmits the driving current generated in the fourth transistor in response to the control signal applied through the control line. The organic light emitting diode receives the driving current from the fifth transistor to emit light.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to exemplary embodiments of the present invention, which are illustrated in the accompanying drawings.

Figure 1:
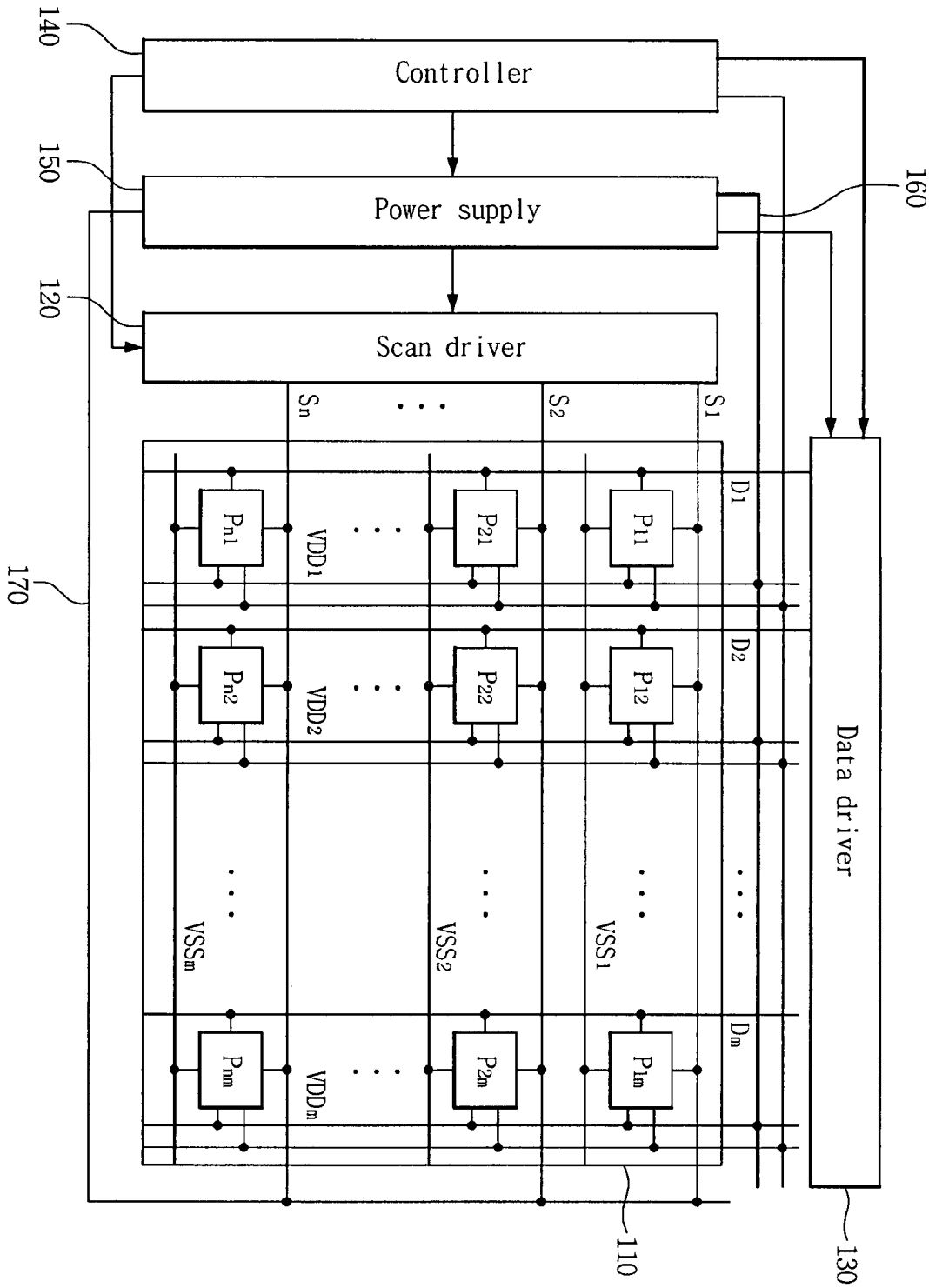
FIG. 1 (Related Art)
FIG. 1 is a block diagram of a related art organic light emitting display.
Figure 2:
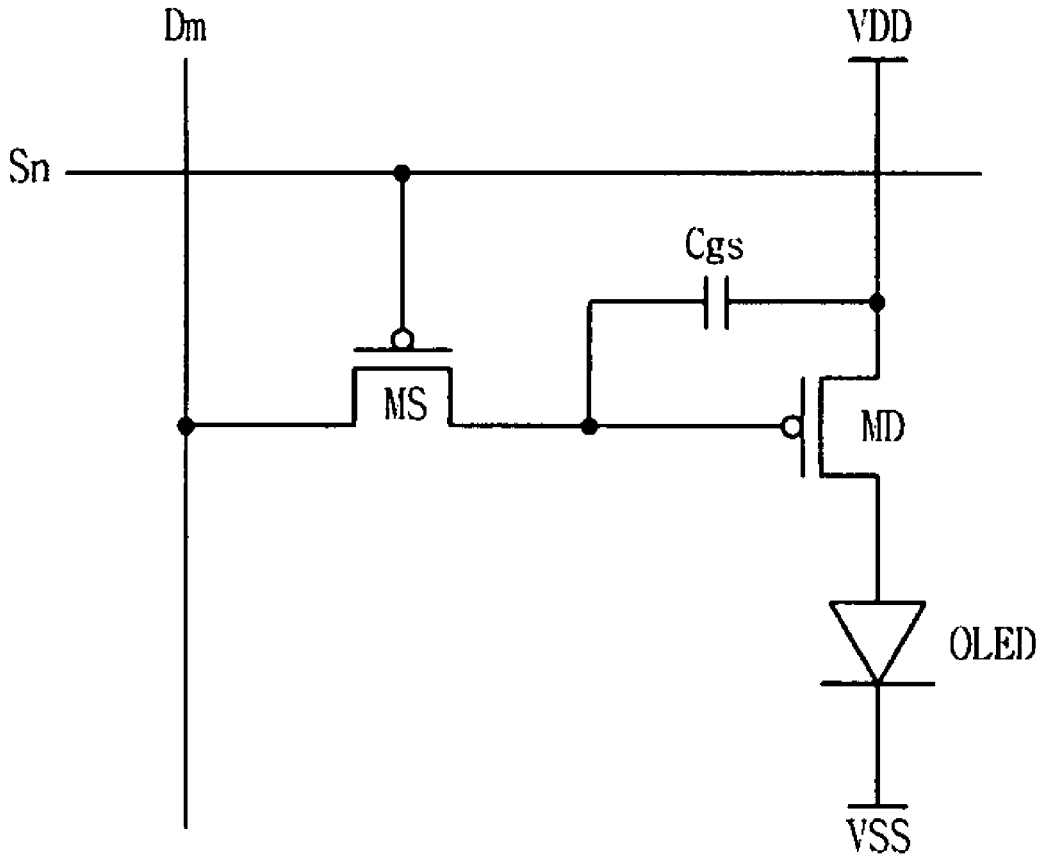
FIG. 2 (Related Art)
FIG. 2 is a circuit diagram of a pixel circuit of a related art organic light emitting display.
Figure 3:
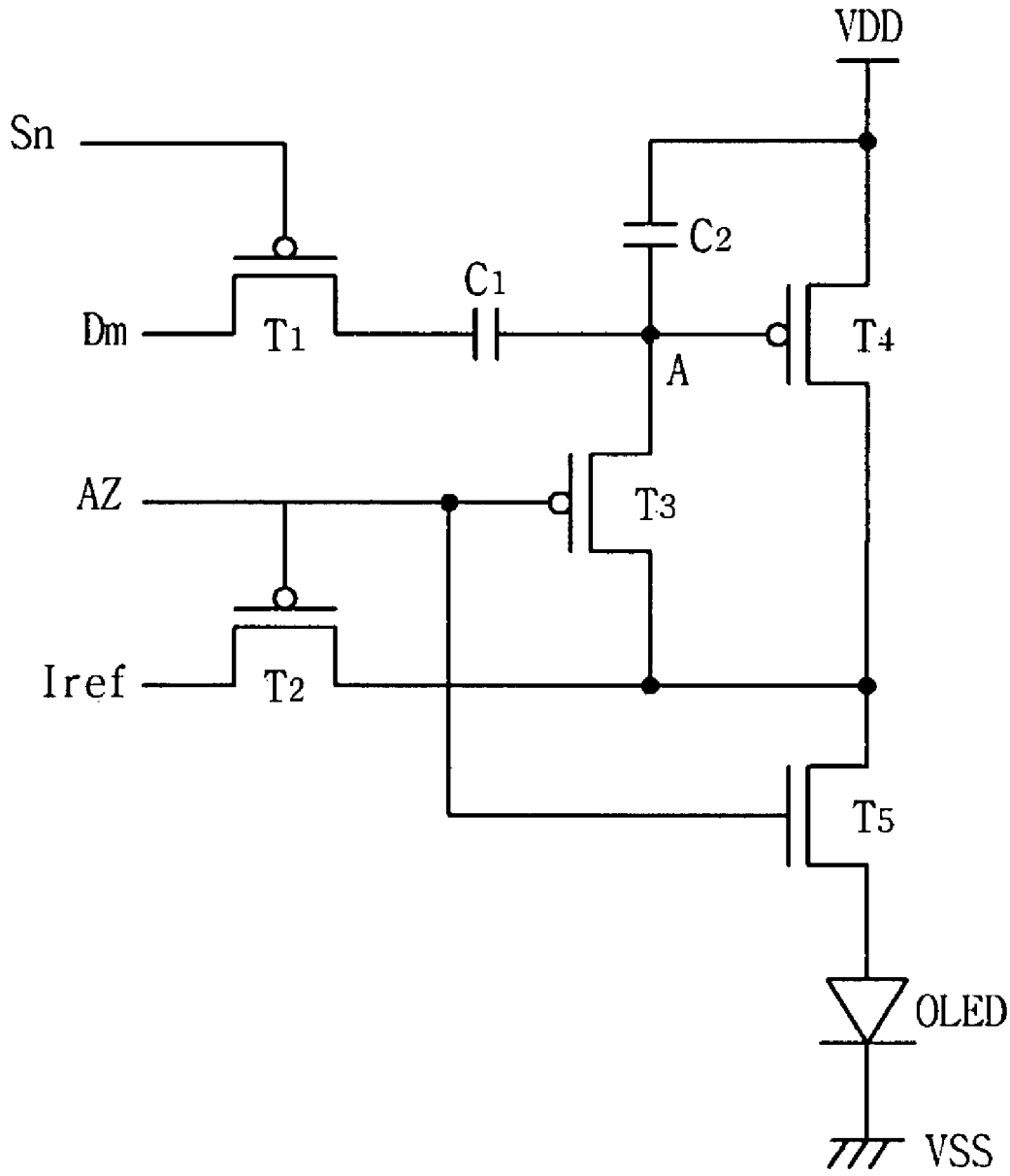
FIG. 3 is a circuit diagram of a pixel circuit of an organic light emitting display according to an embodiment.

FIG. 3 is a circuit diagram of a pixel circuit of an organic light emitting display according to an embodiment.

Referring to FIG. 3, the pixel circuit of the organic light emitting display according to an embodiment includes first to fifth transistors T1, T2, T3, T4 and T5, first and second capacitors C1 and C2, and an organic light emitting diode OLED.

A gate electrode of the first transistor T1 is connected to a scan line Sn, and an electrode of the first transistor T1 is connected to a data line Dm. Hence, the first transistor T1 applies signals from the data line Dm to a first electrode of the first capacitor C1 connected to the other electrode of the first transistor T1 in response to a selection signal of the scan line Sn.

A second electrode of the first capacitor C1 is connected to a first electrode of the second capacitor C2 and a gate electrode of the fourth transistor T4. A second electrode of the second capacitor C2 is connected to a first power supply line VDD. Hence, the fourth transistor T4 receives a combined voltage of the first and second capacitors C1 and C2 produced by combining voltages stored in the first and second capacitors C1 and C2 at a predetermined ratio. Furthermore, the fourth transistor T4 is turned on, and generates a driving current corresponding to the combined voltage.

Gate electrodes of the second, third and fifth transistors T2, T3 and T5 are connected to a control line AZ such that the second, third and fifth transistors T2, T3 and T5 are turned on in response to a control signal of the control line AZ.

The second and third transistors T2 and T3 are turned on in response to a low level control signal of the control line AZ to input a reference current $I_{ref}$ to the fourth transistor T4. Hence, the first and second capacitors C1 and C2 store a compensating voltage reflecting a threshold voltage and mobility of the fourth transistor T4.

The fifth transistor T5 is turned on in response to a high level control signal of the control line AZ to transmit the driving current generated in the fourth transistor T4 to the organic light emitting diode OLED.

The organic light emitting diode OLED includes an anode electrode, a cathode electrode, and a light emitting layer interposed between the anode electrode and the cathode electrode. The anode electrode is connected to the other electrode of the fifth transistor T5, and a voltage VSS of a second power supply is applied to the cathode electrode. Accordingly, the organic light emitting diode OLED emits light corresponding to the driving current by the driving current transmitted to the anode electrode and the voltage VSS of the second power supply applied to the cathode electrode.

Figure 4:
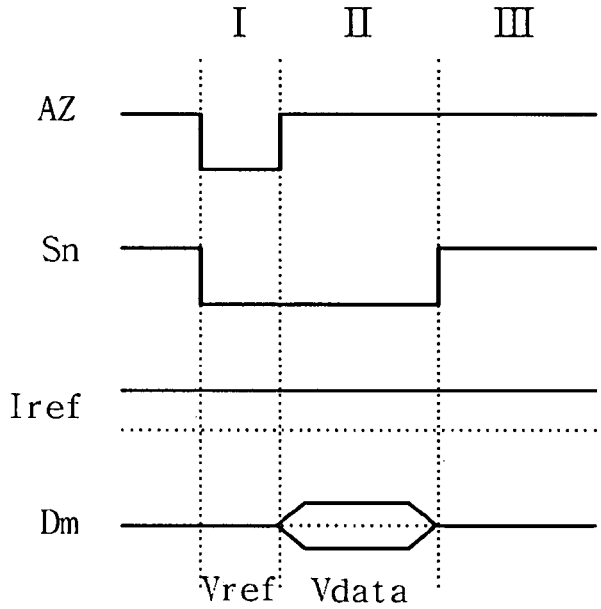
FIG. 4 is a timing diagram of an operation of a pixel circuit of an organic light emitting display according to an embodiment.
Figure 5:
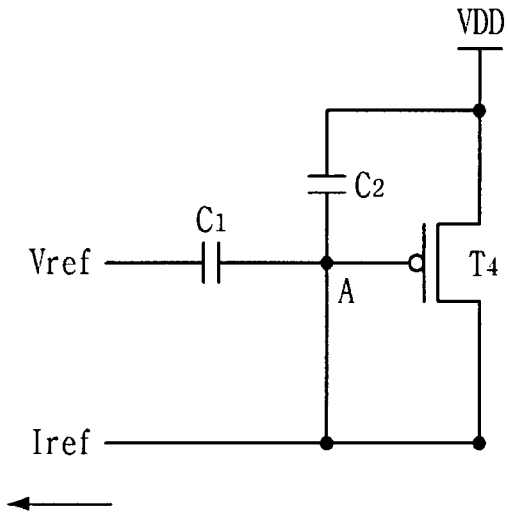
FIG. 5 is a circuit diagram of a compensation step of a pixel circuit of an organic light emitting display according to an embodiment.
Figure 6:
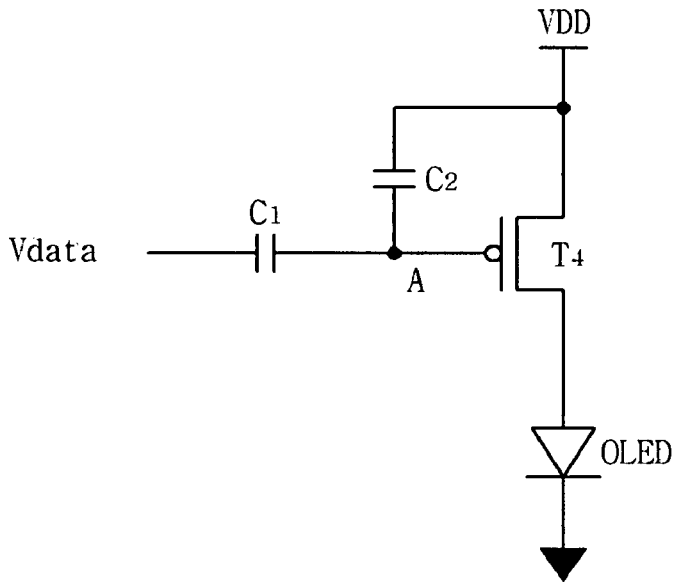
FIG. 6 is a circuit diagram of a data inputting step of a pixel circuit of an organic light emitting display according to an embodiment.
Figure 7:
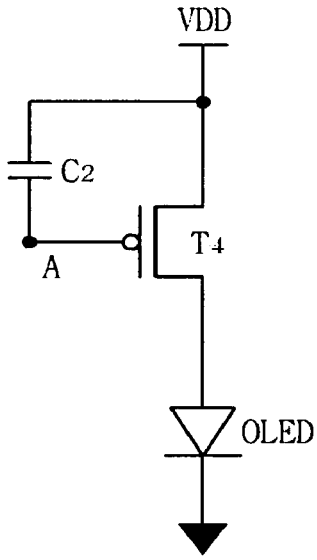
FIG. 7 is a circuit diagram of a light-emitting step of a pixel circuit of an organic light emitting display according to an embodiment.

FIG. 4 is a timing diagram of an operation of a pixel circuit of an organic light emitting display according to an embodiment. FIGS. 5 to 7 are circuit diagrams of operations in a compensation step, a data inputting step, and a light-emitting step of a pixel circuit of an organic light emitting display according to an embodiment, respectively.

Referring to FIGS. 4 and 5, when a low level signal is applied through the scan line Sn and the control line AZ in a compensation step I, the first transistor T1 transmits a reference signal $V_{ref}$ to the first capacitor C1 from the data line Dm and the second and third transistors T2 and T3 input the reference current $I_{ref}$ to the fourth transistor T4 functioning as a driving transistor.

The first and second capacitors C1 and C2 store a compensating voltage reflecting a threshold voltage $Vth_{T4}$ and a mobility $K_4$ of the fourth transistor T4. A voltage $V_A$ of a node A is expressed by the following Equation 2.

[Equation 2]

$$I_{Ref} = \frac{1}{2}K_4(V_A - VDD - Vth_{T4})^2 \quad (1)$$

$$V_A = -\sqrt{\frac{2I_{ref}}{K_4}} + VDD + Vth_{T4} \quad (2)$$

Next, referring to FIGS. 4 and 6, when a low level signal is applied through the scan line Sn in a data inputting step II, the first transistor T1 transmits a data signal $V_{Data}$ to the first capacitor C1. A voltage $V_A'$ of the node A is expressed by the following Equation 3.

[Equation 3]

$$V_A' = V_A + (V_{Data} - V_{ref})\frac{C_1}{C_1 + C_2}$$

Where C1 and C2 denote capacitances of the first and second capacitors C1 and C2, respectively.

Referring to FIGS. 4 and 7, the fifth transistor T5 is turned on in response to a high level signal applied through the control line AZ in a light-emitting step III. Due to the turn-on fifth transistor T5, the fourth transistor T4 generates the driving current by the voltage $V_A'$ stored in the node A and transmits the driving current to the organic light emitting diode OLED. Furthermore, the organic light emitting diode OLED emits light corresponding to the transmitted driving current.

A current flowing into the organic light emitting diode OLED is expressed by the following Equation 4.

$$I_{OLED} = \frac{1}{2}K_4\left[V_A + (V_{Data} - V_{ref})\frac{C_1}{C_1 + C_2} - VDD - Vth_{T4}\right]^2 \quad \text{[Equation 4]}$$

The following equation 5 is obtained by substituting the above Equation 2(2) for the above Equation 4.

$$I_{OLED} = \frac{1}{2}K_4\left[\underbrace{-\sqrt{\frac{2I_{ref}}{K_4}}}_{(a)} + \underbrace{\frac{(V_{Data} - V_{ref})\frac{C_1}{C_1 + C_2}}{(b)}}\right]^2 \quad \text{[Equation 5]}$$

As can be shown from the above Equation 5, the threshold voltage $Vth_{T4}$ of the fourth transistor T4 is removed, and the current $I_{OLED}$ flowing into the organic light emitting diode OLED may be proportional to the data signal $V_{Data}$ and the reference signal $V_{ref}$. A part (a) of the above Equation 5 shows characteristics of a current driving method regardless of a channel width to channel length ratio and the mobility $K_4$ of the fourth transistor T4 by canceling $K_4$ of the fourth transistor T4. A part (b) of the above Equation 5 shows characteristics of a voltage driving method compensating for only the threshold voltage. Accordingly, the organic light emitting display according to an embodiment may provide the pixel circuit reflecting merits of each driving method by properly controlling the reference current $I_{ref}$ and capacitances of the first and second capacitors C1 and C2.

Furthermore, as can be shown from the above Equation 5, the current $I_{OLED}$ flowing into the organic light emitting diode OLED may be proportional to the data signal $V_{Data}$ and the reference signal $V_{ref}$ by removing the voltage VDD of the first power supply. Hence, the pixel circuit of the organic light emitting display according to an embodiment can solve non-uniformity between luminances of pixels depending on a voltage drop in the voltage VDD of the first power supply.

Accordingly, the pixel circuit of the organic light emitting display according to an embodiment can solve non-uniformity between luminances of pixels depending on characteristics and a voltage drop of the driving transistor.

As described above, in the pixel circuit of the organic light emitting display according to an embodiment, the reference current is input before inputting the data signal such that the first and second capacitors store the voltage reflecting characteristics of the fourth transistor being the driving transistor. Accordingly, the pixel circuit of the organic light emitting display according to an embodiment can prevent non-uniformity between luminances of pixels depending on the characteristics of the driving transistor.

The pixel circuit of the organic light emitting display according to an embodiment secures uniformity between luminances of pixels to improve the image quality.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A pixel circuit of an organic light emitting display comprising:

a first transistor that transmits a reference signal or a data signal in response to a selection signal applied through a scan line;

second and third transistors that input a reference current in response to a control signal applied through a control line;

a first capacitor that stores a voltage compensated by the input reference current to compensate for the data signal received from the first transistor;

a second capacitor that receives the data signal compensated by the first capacitor to store the compensated data signal;

a fourth transistor that receives the compensated data signal stored in the second capacitor to generate a driving current;

a fifth transistor that transmits the driving current generated in the fourth transistor in response to the control signal applied through the control line; and an organic light emitting diode that receives the driving current from the fifth transistor to emit light.

2. The pixel circuit of claim 1, wherein the second and third transistors are turned on in response to a first level control signal of the control line, and the fifth transistor is turned on in response to a second level control signal of the control line.

3. The pixel circuit of claim 1, wherein when a first level selection signal and the control signal are applied through the scan line and the control line respectively, the reference signal is applied to the first capacitor from a data line and the reference current is input to the fourth transistor.

4. The pixel circuit of claim 3, wherein when the reference current is input to the fourth transistor, the first and second capacitors store a compensating voltage that reflects characteristics of the fourth transistor.

5. The pixel circuit of claim 4, wherein when a second level control signal is applied through the control line, the data signal is applied to the first capacitor from the data line and the first capacitor applies the compensated data signal to the second capacitor.

6. The pixel circuit of claim 5, wherein the fourth transistor generates the driving current due to the compensated data signal, and the fifth transistor transmits the driving current to the organic light emitting diode due to the second level control signal of the control line.

7. The pixel circuit of claim 1, wherein the first to fourth transistors are a p-channel metal-oxide semiconductor (PMOS) transistor, and the fifth transistor is an n-channel metal-oxide semiconductor (NMOS) transistor.

8. An organic light emitting display comprising:

a pixel circuit, the pixel circuit comprising:

a first transistor that transmits a reference signal or a data signal in response to a selection signal applied through a scan line;

second and third transistors that input a reference current in response to a control signal applied through a control line;

a first capacitor that stores a voltage compensated by the input reference current to compensate for the data signal received from the first transistor;

a second capacitor that receives the data signal compensated by the first capacitor to store the compensated data signal;

a fourth transistor that receives the compensated data signal stored in the second capacitor to generate a driving current;

a fifth transistor that transmits the driving current generated in the fourth transistor in response to the control signal applied through the control line; and an organic light emitting diode that receives the driving current from the fifth transistor to emit light.

9. The organic light emitting display of claim 8, wherein the second and third transistors are turned on in response to a first level control signal of the control line, and the fifth transistor is turned on in response to a second level control signal of the control line.

10. The organic light emitting display of claim 8, wherein when a first level selection signal and the control signal are applied through the scan line and the control line respectively, the reference signal is applied to the first capacitor from a data line and the reference current is input to the fourth transistor.

11. The organic light emitting display of claim 10, wherein when the reference current is input to the fourth transistor, the first and second capacitors store a compensating voltage that reflects characteristics of the fourth transistor.

12. The organic light emitting display of claim 11, wherein when a second level control signal is applied through the control line, the data signal is applied to the first capacitor from the data line and the first capacitor applies the compensated data signal to the second capacitor.

13. The organic light emitting display of claim 12, wherein the fourth transistor generates the driving current due to the compensated data signal, and the fifth transistor transmits the driving current to the organic light emitting diode due to the second level control signal of the control line.

14. The organic light emitting display of claim 8, wherein the first to fourth transistors are a p-channel metal-oxide semiconductor (PMOS) transistor, and the fifth transistor is an n-channel metal-oxide semiconductor (NMOS) transistor.

* * * * *